US009308622B2

(12) United States Patent
Li et al.

(10) Patent No.: US 9,308,622 B2
(45) Date of Patent: Apr. 12, 2016

(54) LAPPING HEAD WITH A SENSOR DEVICE ON THE ROTATING LAPPING HEAD

(71) Applicant: Seagate Technology LLC, Cupertino, CA (US)

(72) Inventors: Leping Li, Bloomington, MN (US); Andrew S. Menz, Shakopee, MN (US); John F. Schmidt, Cushing, MN (US); Stephen J. Mackin, St. Louis Park, MN (US)

(73) Assignee: Seagate Technology LLC, Cupertino, CA (US)

( * ) Notice: Subject to any disclaimer, the term of this patent is extended or adjusted under 35 U.S.C. 154(b) by 75 days.

(21) Appl. No.: 14/057,368

(22) Filed: Oct. 18, 2013

(65) Prior Publication Data

US 2015/0111468 A1 Apr. 23, 2015

(51) Int. Cl.

| | |
|---|---|
| ***B24B 49/10*** | (2006.01) |
| ***B24B 37/013*** | (2012.01) |
| ***B24B 37/04*** | (2012.01) |
| ***B24B 49/12*** | (2006.01) |

(52) U.S. Cl.

CPC ..... *B24B 49/105* (2013.01); *B24B 37/013* (2013.01); *B24B 37/048* (2013.01); *B24B 49/12* (2013.01)

(58) Field of Classification Search

CPC .. B24B 37/013; B24B 37/015; B24B 37/046; B24B 37/048; B24B 37/10; B24B 47/12; B24B 49/105; B24B 49/14; H02K 13/12

See application file for complete search history.

(56) References Cited

U.S. PATENT DOCUMENTS

| | | | | |
|---|---|---|---|---|
| 3,483,307 | A * | 12/1969 | Goodman, Jr. | 174/21 JC |
| 4,156,155 | A * | 5/1979 | Cannell et al. | 310/219 |
| 4,433,510 | A | 2/1984 | Katagiri et al. | |
| 5,386,666 | A | 2/1995 | Cole | |
| 7,046,001 | B2 * | 5/2006 | Tada et al. | 324/230 |
| 7,101,258 | B2 * | 9/2006 | Ising | 451/7 |
| 7,898,140 | B2 * | 3/2011 | Nies | 310/231 |
| 8,292,694 | B2 * | 10/2012 | Togawa et al. | 451/7 |
| 8,951,096 | B2 * | 2/2015 | Kanzow et al. | 451/5 |
| 2005/0054272 | A1 * | 3/2005 | Takahashi et al. | 451/41 |
| 2005/0066739 | A1 * | 3/2005 | Gotkis et al. | 73/760 |
| 2008/0242203 | A1 | 10/2008 | Abe et al. | |
| 2011/0124269 | A1 * | 5/2011 | Tada et al. | 451/5 |
| 2014/0020829 | A1 * | 1/2014 | Chen et al. | 156/345.13 |
| 2015/0038058 | A1 * | 2/2015 | Frazee et al. | 451/47 |

OTHER PUBLICATIONS www.mercotac.com, Mercotac brochure, available prior to Oct. 18, 2013, 8 pages.

* cited by examiner

*Primary Examiner* — Timothy V Eley

(74) *Attorney, Agent, or Firm* — Westman, Champlin & Koehler, P.A.

(57) ABSTRACT

The application discloses embodiments of a lapping head including a sensor device in the base structure of the rotating lapping head. For operation, rotation is imparted to the lapping head through a drive motor coupled to the lapping head through a rotating shaft. As disclosed, the sensor device is electrically connected to one or more electronic components or circuitry through the rotating shaft and a rotating electrical connector coupled to the rotating shaft. In embodiments disclosed, the sensor device is an eddy current sensor configured to measure a gap dimension between a sensor element on the lapping head and a conductive platen to provide an in-situs measurement of workpiece thickness.

16 Claims, 10 Drawing Sheets

LAPPING HEAD WITH A SENSOR DEVICE ON THE ROTATING LAPPING HEAD

BACKGROUND

Manufactured components are lapped to remove excess material to control thickness and other parameters of the fabricated components. Illustrative components include slider bars having a row of transducer heads. The slider bars are lapped to control the taper and bow of the slider bar and thickness of the slider bar. During the lapping process, the bar is supported against an abrasive lapping surface. Relative movement between the slider bar against the abrasive lapping surface removes or abrades a layer of material from the bar. The amount or thickness of the material removed is dependent upon the abrasion of the lapping surface, lapping force and lapping time. Lapping time is increased to increase the thickness of material removed or the lapping time is decreased to reduce the thickness of material removed. For slider bars or components, a pre-set lapping time can be used to control the lapping process and thickness of material removed. Variations in the bar dimensions and parameters can introduce variations in the thickness dimensions of the transducer heads fabricated from the bar using the pre-set lapping time. Embodiments of the present invention provide solutions to these and other problems, and offer other advantages over the prior art.

SUMMARY

The application relates to a lapping head including a sensor device in the base structure of the rotating head. For lapping operations, rotation is imparted to the head through a drive motor coupled to the head through a rotating shaft. As disclosed, the sensor device is electrically coupled to one or more electronic components or circuitry through the rotating shaft and a rotating electrical connector coupled to the rotating shaft. In embodiments disclosed, the sensor device is an eddy current sensor configured to measure a gap dimension between a sensor element on the lapping head and a conductive platen to provide an in-situ measurement corresponding to a thickness of the workpiece. As described, embodiments of the lapping head are used to lap slider bars for fabricating transducer heads for data storage devices. The bars are coupled to the lapping head through a carrier and feedback from the sensor device is used to control the lapped thickness or other parameters of the slider bars. Other features and benefits that characterize embodiments of the present invention will be apparent upon reading the following detailed description and review of the associated drawings.

DETAILED DESCRIPTION OF ILLUSTRATIVE EMBODIMENTS

Figure 1:
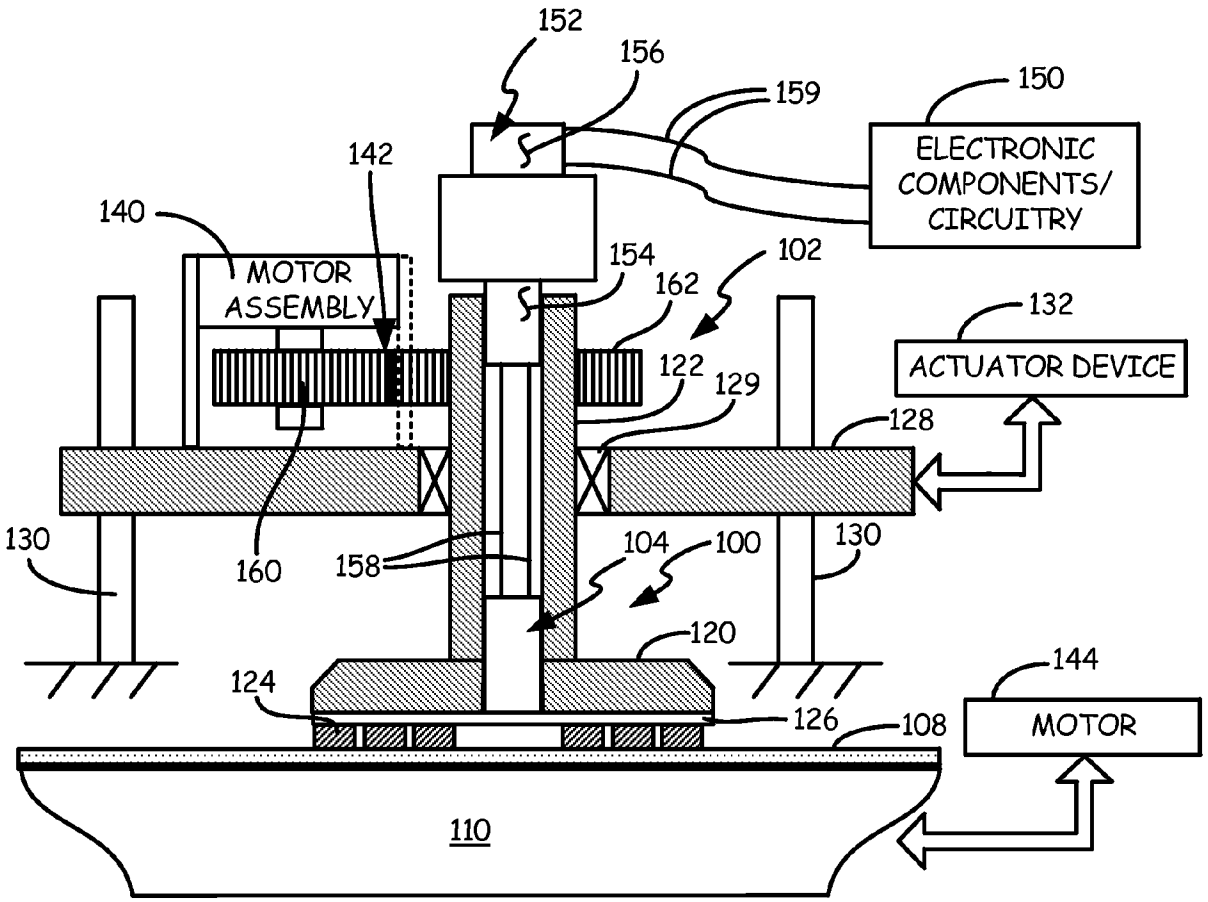
FIG. 1 schematically illustrates an embodiment of a lapping head having a sensor or other device in a base structure or plate of the head.

The present application relates to a lapping head 100 for a lapping assembly 102 having a sensor device 104 on the lapping head 100. The head 100 rotates relative to an abrasive lapping surface of an abrasive lapping film 108 on a rotating platen 110. The head 100 includes a base structure 120 coupled to an elongate shaft 122. One or more workpieces 124 are coupled to the base structure 120 through a workpiece carrier 126 to support the workpieces 124 for lapping. The shaft 122 is rotationally coupled to a platform structure 128 through a bearing 129 (illustrated schematically) to rotate the head 100 relative to the abrasive lapping surface or film 108 to abrade or remove material from the one or more workpieces 124. In the embodiment shown in FIG. 1, the platform structure 128 is movably supported relative to the abrasive lapping surface or film 108 to bias the base structure 120 of the head 100 against the abrasive lapping surface or film 108.

In the illustrated embodiment, the platform structure 128 is movable along rails 130 via an actuator device 132 to raise and lower the base structure 120 of the head 100 relative to the abrasive lapping surface or film 108 and to bias the head 100 against the abrasive lapping surface or film 108. Illustrative actuator devices 132 are pneumatic or electrical actuator devices. As shown, a motor 140 is coupled to shaft 122 through a gear assembly 142 to rotate the base structure 120 and workpieces 124 relative to the abrasive lapping surface or film 108. As illustrated, the motor 140 is supported on the platform structure 128 and is moveable therewith. In the illustrated embodiment, the assembly also includes a motor 144 to rotate the platen 110 to lap the workpieces 124 via rotation of both the platen 110 and the head structure 100 supporting the workpieces 124. Although not shown, the lapping assembly can include multiple heads biased against the same abrasive lapping surface or film 108 to enhance capacity. Thus, it should be understood that the axis of rotation of the head 100 is not concentric with a rotation axis of the platen 110.

As shown, the sensor device 104 on the rotating head 100 is coupled to electronic components or circuitry 150 through the rotating shaft 122 and a rotating electrical connector 152 coupled to the rotating shaft 122. The rotating electrical connector 152 includes a rotating portion 154 coupled to the shaft 122 and a stationary portion 156 to provide an electrical connection between the sensor device 104 on the rotating head 100 and the stationary electronic components or circuitry 150 supported on the frame of the device or assembly 102. As shown, the base structure 120 of the head is coupled to a proximal end of the shaft 122 proximate to the abrasive lapping surface or film 108. The rotating portion 154 of the rotating electrical connector 152 is coupled to a distal end of the shaft 122 and rotates with the shaft 122.

The sensor device 104 electrically connects to the rotary portion 154 of the connector 152 through leads 158. The stationary portion 156 of connector 152 is coupled to the rotary portion 154 and to the one or more electronic components or circuitry 150 through leads 159 to provide the interface between the sensor device 104 and the one or more electronic components or circuitry 150. Illustratively, the electronic components or circuitry 150 include one or more hardware devices and software configured to process input from the sensor device 104. The electronic components or circuitry 150 also include controller algorithms to operate and control motors 140, 144 and actuator device 132 to start and stop the lapping process. In illustrated embodiments, the one or more hardware devices include memory device, such as flash memory and solid state memory devices and processors for implementing the various controller or measurement algorithms.

For lapping operations, the head and base structure 120 rotate via motor 140 axially displaced from a rotation axis of the shaft 122. As previously described, the base structure 120 is coupled to the proximal end of the shaft 122 of the head 100 and the rotating electrical connector 152 is coupled to the distal end of the shaft 122. The motor 140 is coupled to a body of the shaft 122 between the proximal and distal ends of the shaft 122 through the gear assembly 142 which includes at least one gear 160 coupled to and rotated through the motor 140 and at least one gear 162 coupled to the shaft 122 and rotated by the at least one gear 160 coupled to the motor 140. Gear 160 is axially aligned with a rotation axis of the motor and gear 162 is concentric with the shaft 122. Gear 162 is axially spaced from the output shaft of the motor 140 and is aligned to interface with gear 160 so that gear 160 imparts rotation to gear 162 to rotate the shaft 122.

Figure 2:
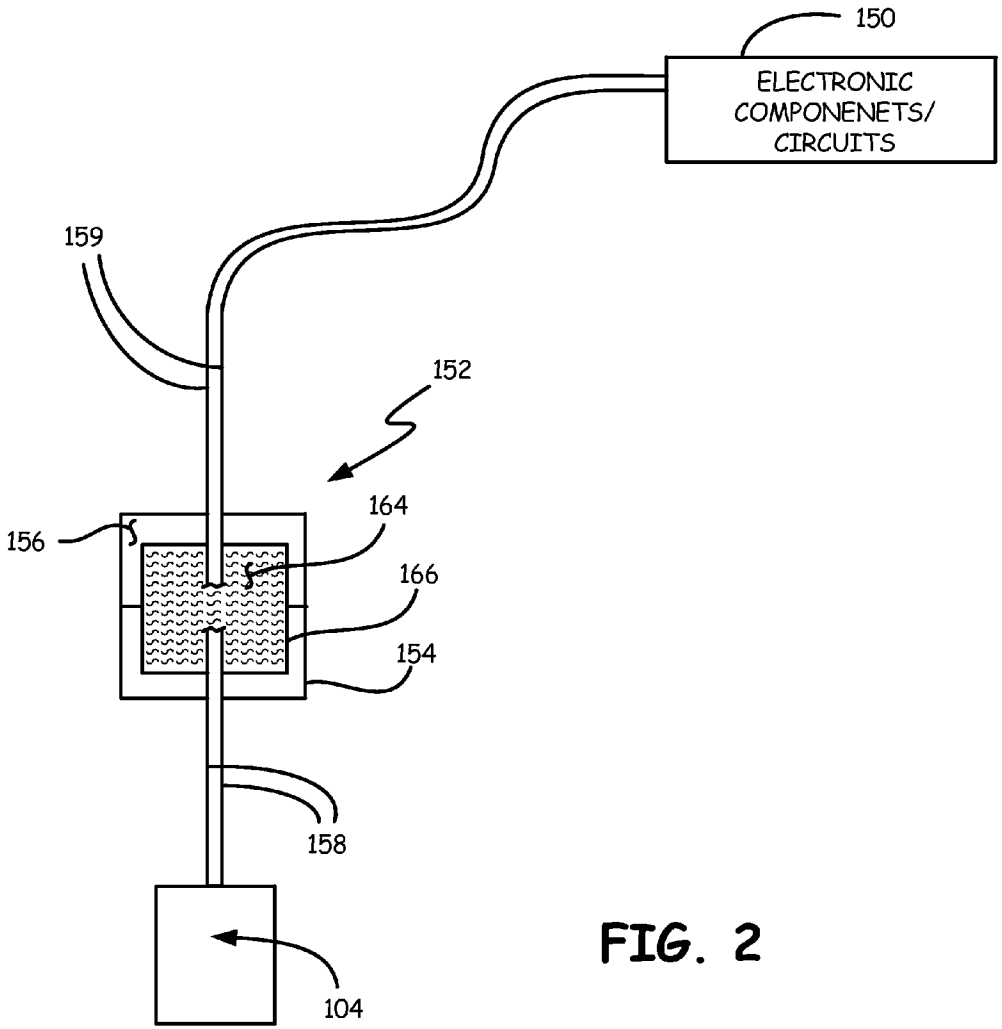
FIG. 2 schematically illustrates operation of a rotating electrical connector for electrically connecting the sensor device on the rotating head to electronic components or circuitry.

FIG. 2 schematically illustrate an embodiment of the rotating electrical connector 152 to provide the electrical interface between the sensor device 104 on the rotating head 100 and the electronic components or circuitry 150. The illustrated rotating electrical connector 152 utilizes an electrically conductive fluid 164 to provide the electrical connection between leads 158 connected to the sensor device 104 and leads 159 connected to the electronic components or circuitry 150. Leads 158 are connected to the electrically conductive fluid 164 through the rotating portion 154 (schematically shown) and leads 159 are connected to the conductive fluid 164 through the stationary portion 156 (also schematically shown). The conductive fluid 164 provides an electrical interface between the leads 158 connected to the rotating portion 154 and the leads 159 connected to the stationary portion 156 to electrically connect the sensor device 104 to the electronic components or circuitry 150 as described. As schematically shown, the electrically conductive fluid 164 is contained in a chamber 166 formed between the rotating portion 154 and the stationary portion 156. Illustratively, the conductive fluid 164 is a liquid metal which provides an electrical interface with relatively low noise or disturbance to reduce measurement error. The conductive fluid interface also limits particle generation from mechanical components to reduce debris. Illustrative rotating electrical connectors 152 utilizing an electrically conductive fluid 164 are available from Mercotac, Inc. of Carlsbad, Calif.

As previously described, the relative movement of the workpieces 124 and abrasive lapping surface or film 108 abrades material from the workpieces 124 generally at a lapping rate dependent upon the workpiece material, abrasion of the abrasive lapping surface or film 108, lapping time and force from the actuator device 132. For small or miniature components, precise control of the lapped thickness and the lapping process is important to reduce tolerance variations for the fabricated components. In the illustrated embodiment shown in FIG. 3, the sensor device 104 on the head 100 is a gap measurement sensor to measure a gap dimension 168 between the base structure 120 (shown in phantom) and the conductive surface of platen 110 which is just below the abrasive lapping or film 108. The gap measurement sensor is configured to measure the gap dimension 168 the sensor device 104 and the conductive surface of platen 110 in-situ and real time during the lapping process to allow precise control the lapped thickness of the one or more workpieces 124 (not shown in FIG. 3).

Figure 3:
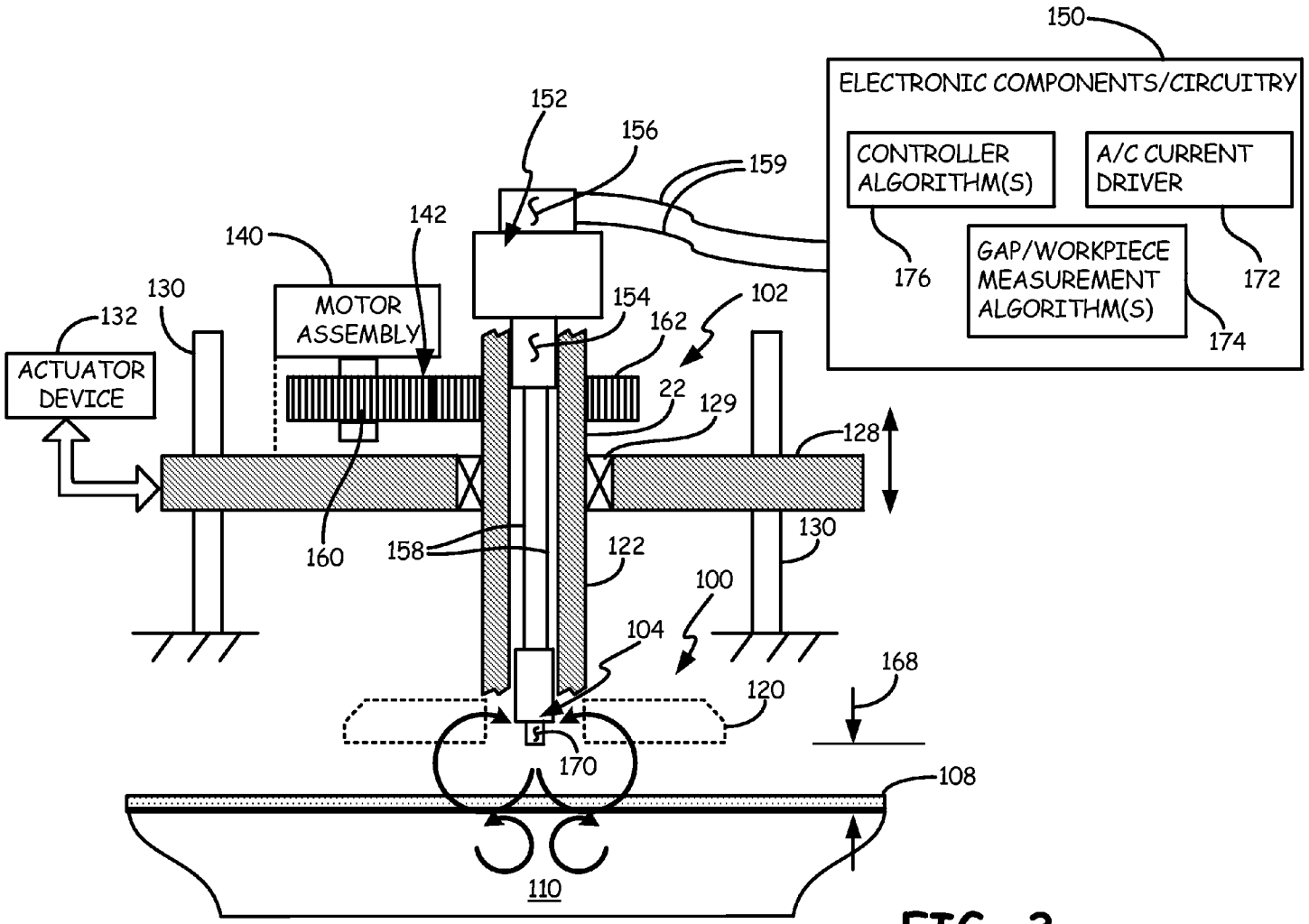
FIG. 3 illustrates a lapping head including an eddy current sensor device for measuring a gap dimension between the rotating lapping head and a conductive platen.

In the embodiment shown in FIG. 3, the gap measurement sensor is an eddy current sensor having a sensor element 170 which includes an inductive coil. The sensor element 170 is supported in the rotating head 100 proximate to the metal or the top surface of the conductive platen 110. As shown in FIG. 3, the sensor element 170 is coupled to an AC (alternating current) driver 172 in the electronic components or circuitry 150 to apply an AC current across the sensor element 170. The AC current driver 172 is coupled to the sensor element 170 through the rotating electrical connector 152 as previously described. The AC current driver 172 generates an alternating magnetic field in the sensor element 170 which induces an eddy current in the metal platen 110 to measure the gap 168 between the sensor element 170 (or coil) and a top of the metal platen 110

The eddy current in the metal platen 110 generates an opposing magnetic field which resists the magnetic field generated in the sensor element 170. The magnitude of the resistance of the opposing magnetic field depends upon the space or gap 168 between the sensor element 170 and a top surface of the platen 110. The interaction of the opposing magnetic field is measured using the output voltage across the sensor element 170 which varies based upon the changing impedance in the sensor element 170 as a result of a change in the gap 168 between the sensor element 170 and the top surface of the conductive platen 110. The output voltage is used by a gap/workpiece thickness measurement algorithm(s) 174 to provide an output measurement corresponding to workpiece thickness to control the lapping process as described. The frequency of the AC current is optimized to reduce interference with noise and vibration frequency of the rotating head 100. The eddy current sensor as described provides an accurate gap measurement despite the presence of non-conductive lubricant and/or debris in the gap between the head 100 and the rotating platen 110. In particular, the eddy current sensor device provides an input signal corresponding to the gap between the sensor element 170 of the device and the top of the platen 110.

The hardware devices and software of the electronics components and circuitry 150 include the measurement algorithm(s) 174 and controller algorithm(s) 176 to process the input from the gap measurement sensor or element 170 (or eddy current sensor) and provide an in-situ and real time workpiece thickness measurement utilizing the measured signal from the sensor element 170. In illustrated embodiments, the algorithms include software instructions stored on the one or more hardware devices and implemented through the processor. The gap measurement is used by the controller algorithm(s) 176 to control the motors 140, 144 and actuator device 132 to increase or decrease the lapping time or duration to control the workpiece thickness. In particular, the controller algorithm(s) 176 use the gap measurement to control the motors 140, 144 and the actuator device 132 to stop the lapping process when a target workpiece thickness is reached.

Figure 4:
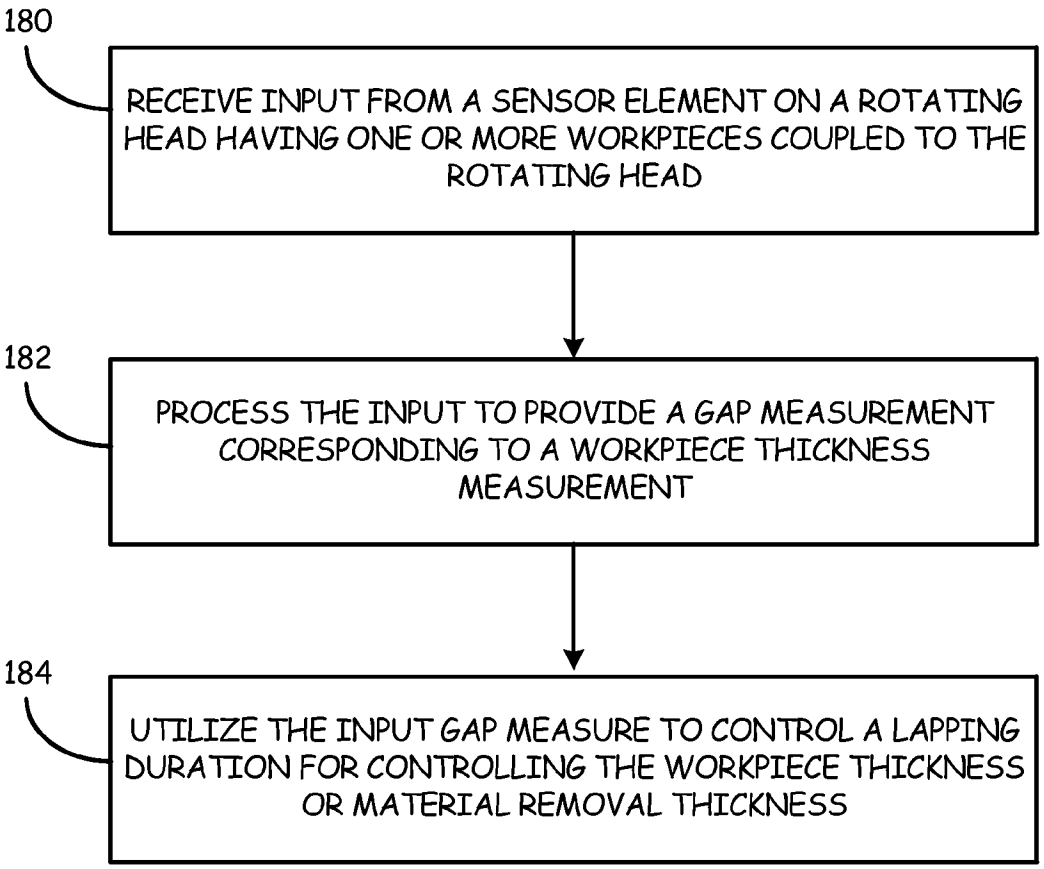
FIG. 4 is a flow chart illustrating process steps for monitoring and controlling a lapping process for a workpiece using input from a sensor device configured to measure a gap between the rotating head and a platen.

FIG. 4 illustrates control of the lapping process via the measurement and controller algorithms 174, 176. As shown in FIG. 4, while the head 100 rotates, input from the sensor device 104 is received and processed in steps 180, 182 to provide the in-situs gap measurement which correlates to a workpiece thickness measurement. In step 184 the input gap measurement is used to control the duration of the lapping process to provide a desired workpiece thickness or material removal thickness. Thus, if the workpiece thickness is larger than the desired workpiece thickness, the lapping process continues to abrade material from the workpiece. If the workpiece thickness is not larger than the desired workpiece thickness, the lapping process is complete and the workpiece 124 is removed from the head 100.

Figure 5:
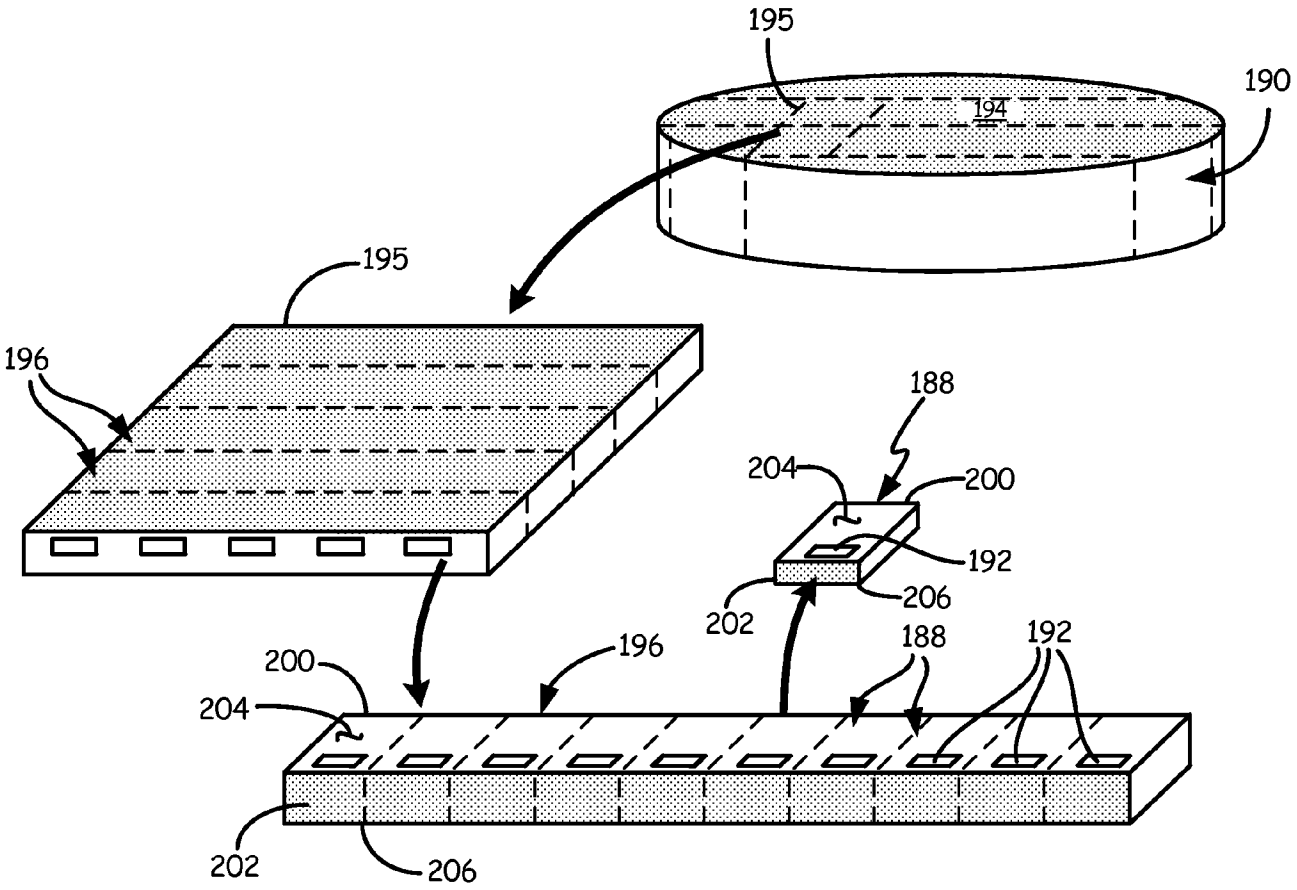
FIG. 5 illustrates a wafer for fabricating transducer heads for a data storage device and a slider bar including a row of transducer heads sliced from the wafer.

Embodiments of the lapping head 100 are used to lap components for transducer heads 188 for data storage devices. As shown in FIG. 5, transducer heads 188 are typically fabricated on a wafer substrate 190. Transducer elements 192 of the heads are deposited or formed on a surface 194 of the wafer substrate 190 using thin film deposition techniques. Following deposition of the transducer elements 192, the wafer 190 is sliced into a bar chunk or stack 195 which is then sliced into bars 196. The sliced bars 196 have a leading edge 200, a trailing edge 202, air bearing surface 204 and a back surface 206. The transducer elements 192 are along the air bearing surface 204 of the slider at the trailing edge 202 of the slider bars 194. Slider bars 196 are lapped to control the thickness of the bar 196 as well as to enhance flatness, bow and perpendicularity of the air bearing surface 204 and back surface 206 of the bar 196. The lapped bar 196 is then sliced to form the individual transducer heads 188 of the data storage device. Typically, the bars 196 are formed of a ceramic material such as Alumina ($Al_2O_3$)—Titanium Carbide (Ti-C).

Figure 6A:
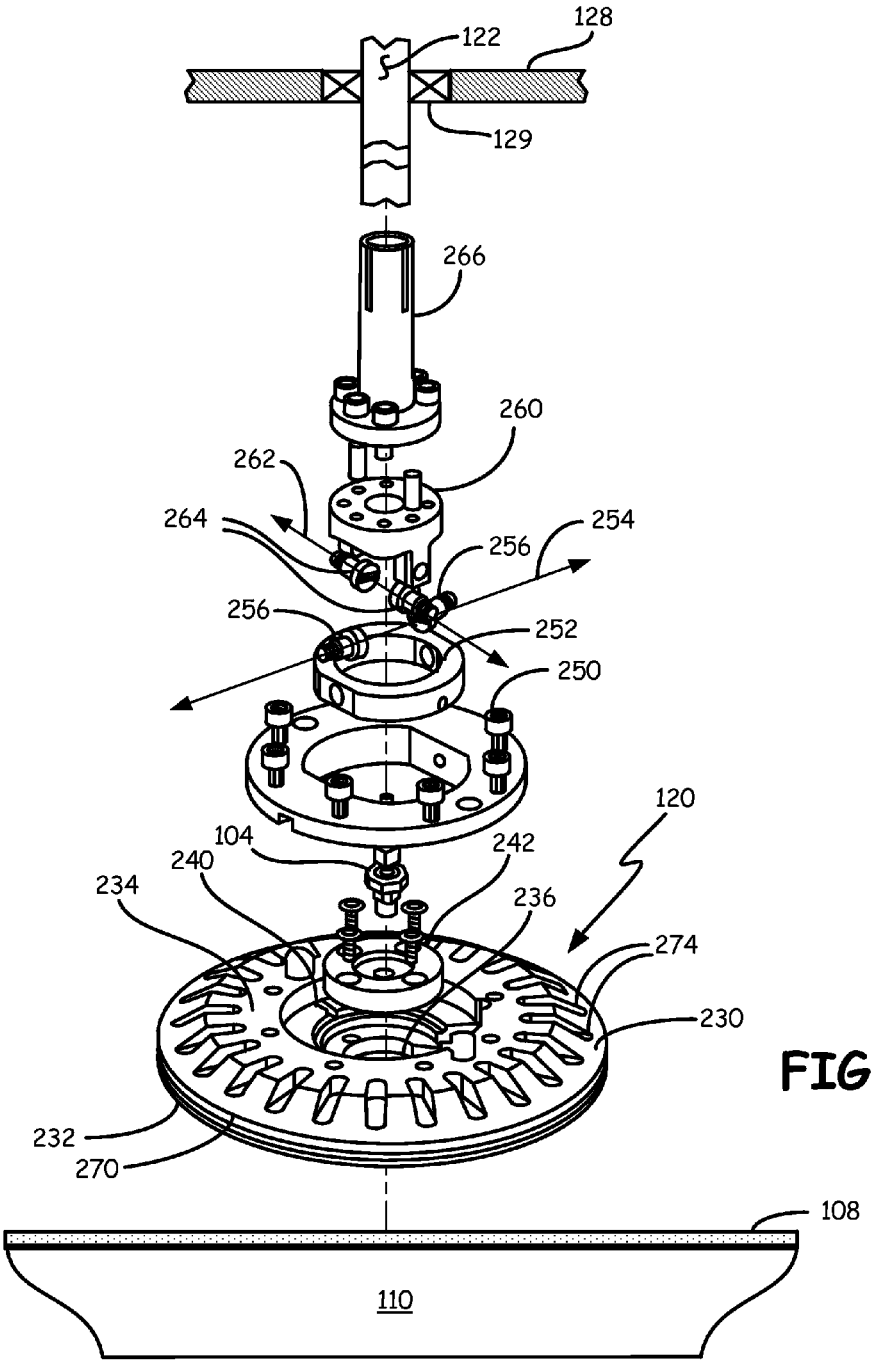
FIGS. 6A-6C illustrate an embodiment of a lapping head including a sensor device on the base structure of the lapping head.
Figure 6C:
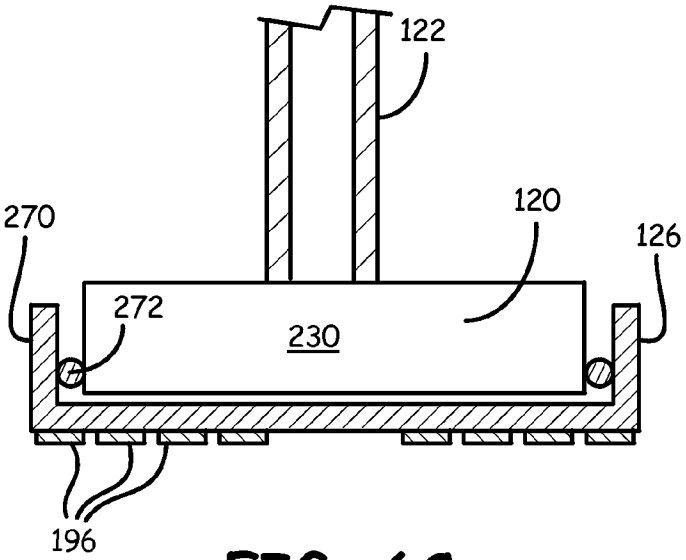
Figure 6B:
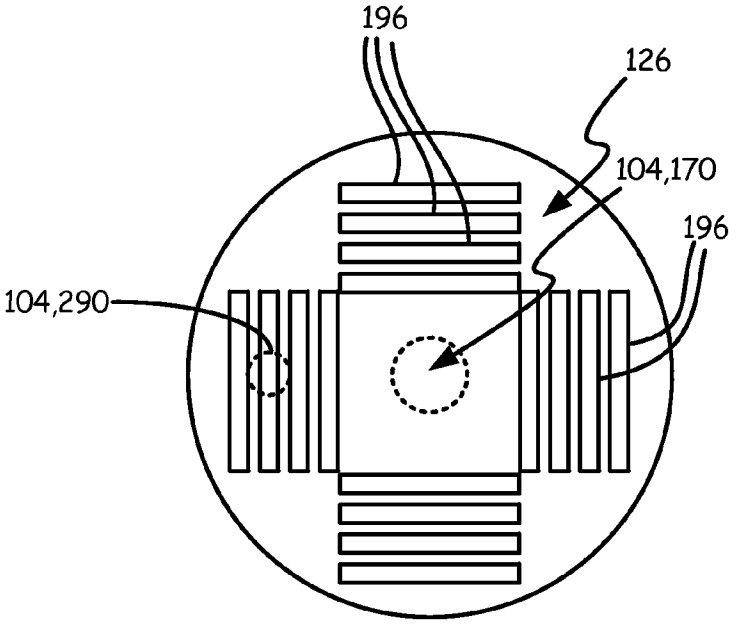

FIGS. 6A-6C illustrate an embodiment of a base structure 120 and carrier 126 having application for lapping slider bars 196 as illustrated in FIG. 5. As shown, the base structure 120 of the head includes a base plate 230 having a front surface 232 facing the platen 110 and a back surface 234. An inner opening 236 extends through the base plate 230 between the back surface 234 and the front surface 232. The sensor device 104 (e.g. gap measurement sensor) is supported in the inner opening 236 of the base plate 230. The inner opening 236 is coaxially aligned with the shaft 122 so that the sensor device 104 is within a center portion of the base structure 120 and not a peripheral portion which could affect measurement accuracy. As shown, the back surface 234 includes one or more stepped surfaces to form an inset cavity 240 for an insulator ring 242. In the embodiment shown, the base plate 230 is formed of a metal or conductive material and the insulator ring 242 is formed of an electrically insulating or non-conductive material for housing an eddy current sensor. The sensor extends through the insulator ring 242 in the inset cavity 240 to electrical isolate the sensor element 170 facing the abrasive lapping surface or film 108 on the front surface 232 of the base plate 230.

In the embodiment shown, the base plate 230 is connected to the shaft 122 through a gimbal assembly to allow the base structure 120 to pivot to follow the contour of the platen 110. As shown, the gimbal assembly includes a base ring 250 connected to the back surface 234 of the base plate 230 and a first gimbal ring 252 pivotally coupled to the base ring 250 to pivot about first axis 254 through pins 256. A second gimbal ring 260 is pivotally coupled to the first gimbal ring 252 to pivot about a second axis 262 generally perpendicular to the first axis 254. A shaft adapter 266 is coupled to the second gimbal ring 260 to connect the base plate 230 to the rotating shaft 122 through the gimbal assembly. The shaft adapter 266 is removable coupled to the shaft 122 through a collet (not shown) to removably connect the base structure 120 or plate to the rotating shaft 122.

Slider bars 196 are lapped utilizing the lapping head 100 to remove material to control the thickness of the bar 196 and dimensions of the transducer heads 188 fabricated from the bar 196. Thus, the slider bars 196 form the workpieces 124 which are connected to the base structure 120 through carrier 126 shown in FIGS. 6B-6C (not shown in FIG. 6A). The carrier 126 is formed of a non-conductive material and as shown in FIG. 6B, a plurality of slider bars 196 are coupled to the carrier 126 for lapping. In the embodiment shown, the slider bars 196 are arranged about a center portion of the carrier 126 and are radially spaced from the sensor element 170 so that bars 196 do not block or interfere with operation of the sensor device 104 in the base plate 230. The slider bars 196 are adhesively connected to the carrier 126. As shown in FIG. 6C, the carrier 126 is connected to the base plate 230 through a friction and/or vacuum fit through engagement of an outer rim 270 of the carrier 126 with an O-ring 272 disposed about an outer perimeter of the base plate 230. In another embodiment, the carrier 126 is threadably connected to the base plate 230 through perimeter threads on the base plate 230 and internal threads (not shown) on the outer rim 270 of the carrier 126.

During the lapping process, contact between the workpieces 124 or slider bars 196 and the abrasive lapping surface or film 108 generates heat which can increase the temperature of the sensor device 104 and base structure 120 of the head. The increased temperature can alter the voltage signal in the sensor element 170 of an eddy current sensor or other sensor device and interfere with gap measurement. In the embodiment, illustrated in FIG. 6A, the back surface 234 of the base plate 230 includes flutes 274 spaced about an outer circumference of the base plate 230. As shown, the flutes 274 increase surface area on a back surface 234 of the base structure 120 of the head allowing it to function as a heat sink to cool the base structure of the head.

Figure 7:
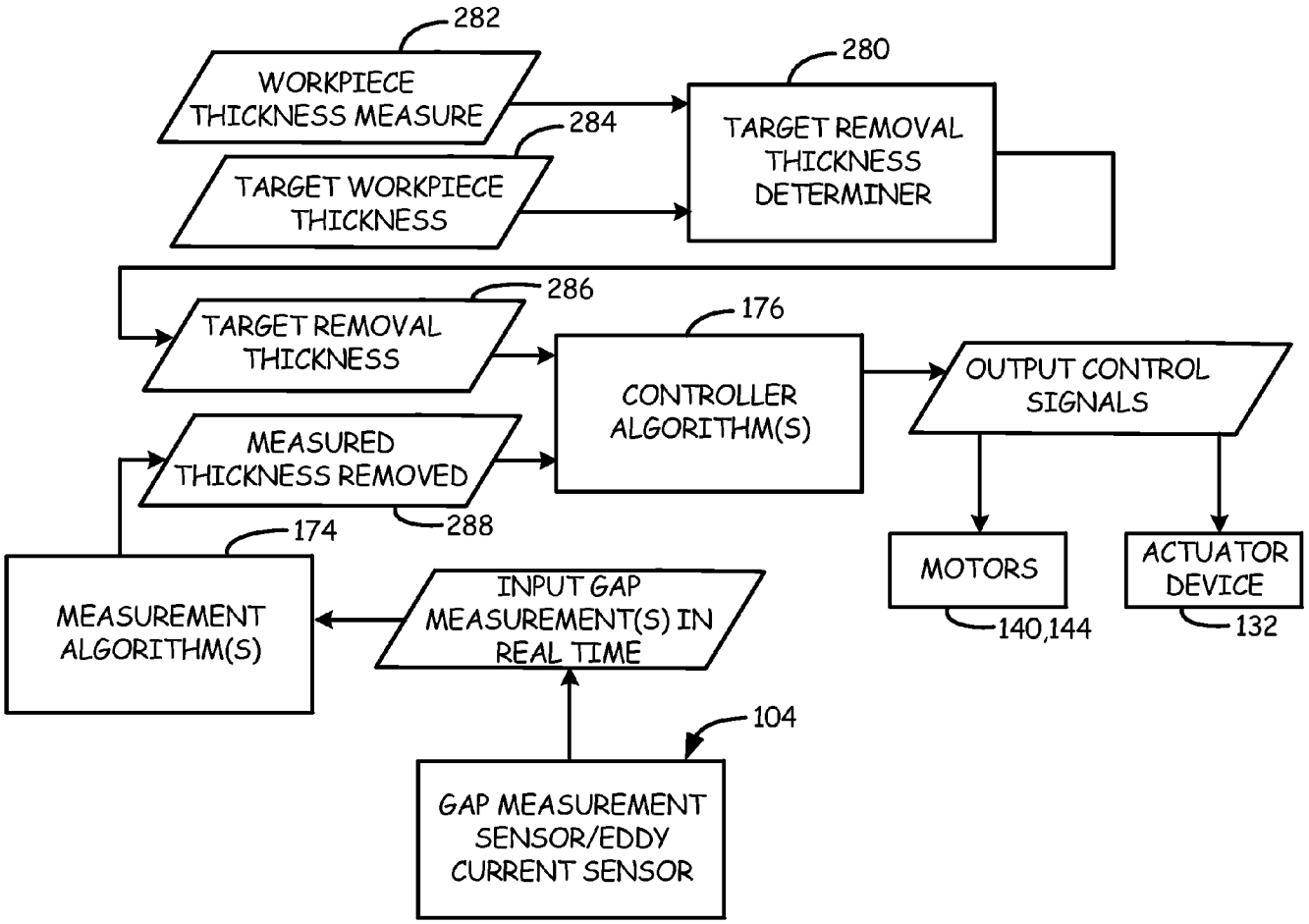
FIG. 7 illustrates an embodiment for controlling a lapping process using a change in gap or measure of thickness removed to control the workpiece thickness relative to a target removal thickness.

FIG. 7 illustrates a process control embodiment utilizing feedback from the gap measurement or eddy current sensor to control a thickness of material removed by the lapping process. In FIG. 7, the process control embodiment includes a target removal thickness determiner 280 that is implemented through instructions stored in memory of the electronic components or circuitry 150. The target removal thickness determiner 280 uses an input workpiece measurement 282 and a preset target workpiece thickness 284 to determine a target removal thickness 286 for lapping. The workpiece thickness measure 282 is provided by a thickness measurement device (not shown). Illustrative thickness measurement devices include optical thickness measurement devices or other device that provides a thickness measurement for the workpiece 124 prior to the lapping process. As shown the controller algorithm(s) 176 receives the target removal thickness 286 and a measured thickness removed 288 from the measurement algorithm(s) 174 and uses the target removal thickness 286 and the measured thickness removed 288 to generate control signals to operate the motors 140, 144 and actuator device 132 to implement the lapping process and stop the lapping process at the desired workpiece thickness.

The measured thickness removed 288 is determined by the measurement algorithm(s) 174 using the input gap measurements from the gap measurement or eddy current sensor. The measurement algorithm(s) 174 calculate a change in gap (Delta Gap) to provide the measured thickness removed 288 input to the controller algorithm(s) 176. The controller algorithm(s) 176 compares the measured thickness removed 288 to the target removal thickness 286 and when the measure thickness removed 288 is at the target removal thickness 286, the controller algorithm(s) 176 outputs control signals for the motors 140, 144 and actuator device 132 to stop the lapping process.

Figure 8:
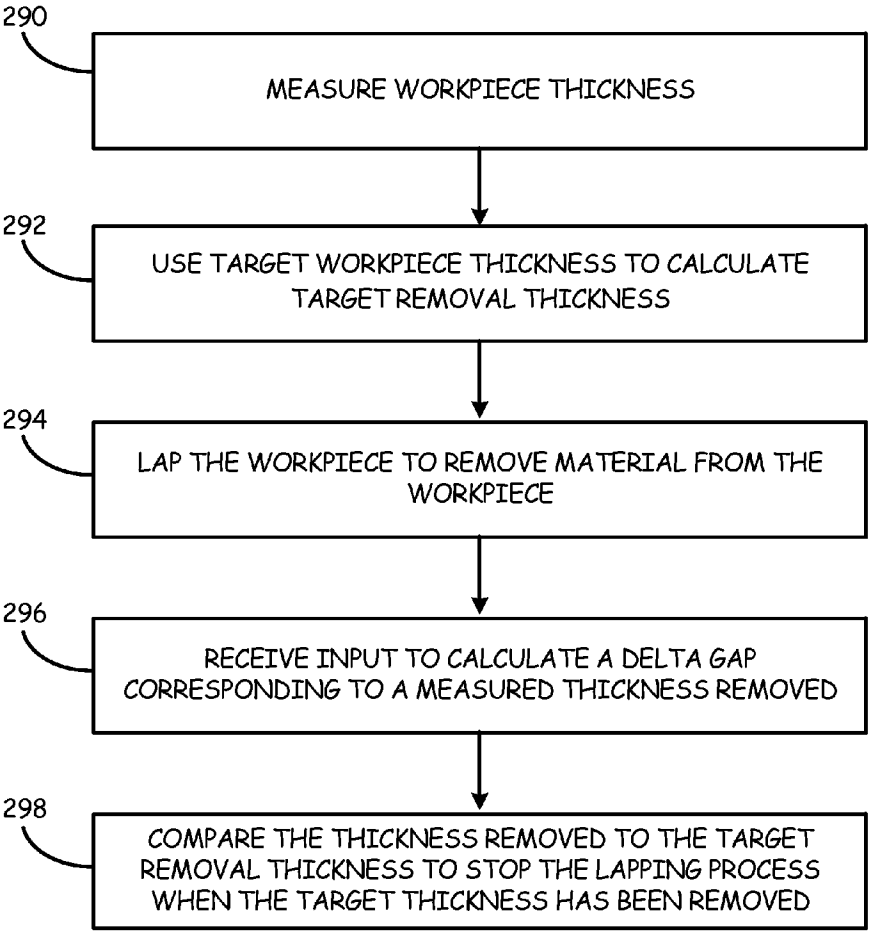
FIG. 8 is a flow chart illustrating process steps for controlling a lapping process for a workpiece.

FIG. 8 illustrates process steps for using a Delta Gap measurement from the gap measurement or eddy current sensor to control the lapping process to abrade the workpiece to the target workpiece thickness 284. As shown in step 290, the workpiece thickness is measured and in step 292, the measured workpiece thickness 282 is compared to the target workpiece thickness 284 to calculate the target removal thickness 286. The workpiece is then lapped in step 294 to remove material from the workpiece 124. In step 296 as the workpiece 124 is lapped, sensor input is received and used to calculate the Delta Gap corresponding to the measured thickness removed 288. In step 298, the thickness removed 288 is compared to the target removal thickness 286, and when the measured thickness removed 288 reaches the target removal thickness 286, the lapping process is stopped. Other embodiments may utilize the input gap measurement directly to control workpiece thickness.

Figure 9:
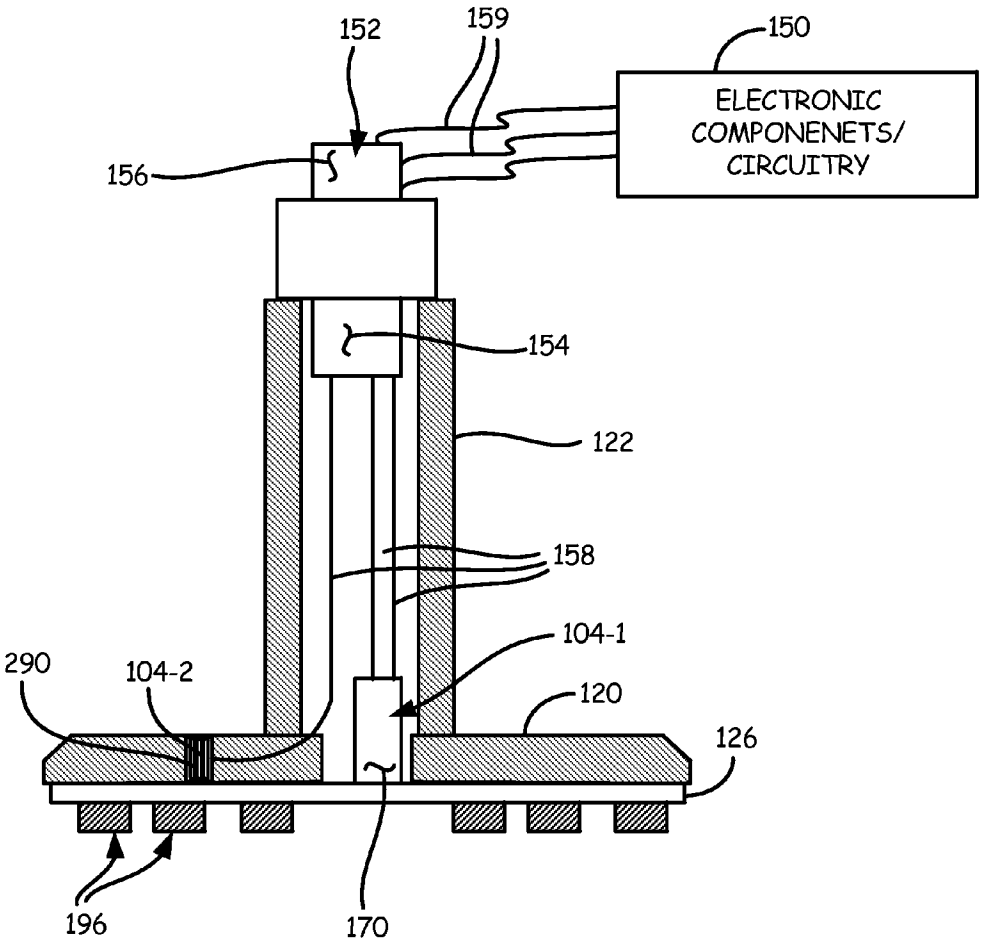
FIG. 9 illustrates an embodiment of a head structure including multiple sensor devices on the base plate of the head structure including a temperature sensor and a gap measurement sensor. The above drawings are for illustrative purposes and the features in the drawings are not necessarily drawn to scale and do not illustrate details of each of the components.

FIG. 9 illustrates an embodiment of a lapping head 100 including multiple sensor devices 104-1, 104-2 coupled to the head 100 and connected to the electronic circuitry or components 150 through the connector 152. In the embodiment shown, the multiple sensor devices 104-1, 104-2 include an eddy current sensor or other gap measurement sensor and a temperature sensor having a temperature sensor element 290 (shown schematically) in the base plate 230 of the base structure 120. In the embodiment shown in FIG. 9, the temperature sensor element 290 is supported on the base structure 120 to compensate for temperature variations that affect accuracy of the gap measurement. In an illustrated embodiment, the temperature sensor element 290 is a thermistor sensor element. The temperature sensor element 290 is electrically connected to the electronic components or circuitry 150 through one or more leads 158 connected to the rotating electrical connector 152 to provide the temperature input to compensate for temperature variations for measuring the gap dimension.

In the embodiment shown in FIG. 9 the temperature sensor element 290 is disposed on the base plate 230 to measure the temperature proximate to the workpiece 124 (or one or more slider bars 196) to provide real-time monitoring of heat input to the system. Placement of the temperature sensor element 290 proximate to the workpiece 124 (or one or more slider bars 196) provides a temperature input close to the heat source generated by friction between the workpiece 124 and the abrasive lapping surface or film 108 (not shown in FIG. 9). Input from the temperature sensor element 290 provides real-time monitoring of heat input and is used to compensate for temperature variations in the bar or workpiece thickness. In particular, in an illustrated embodiment, the measurement algorithm 174 uses the measured temperature to offset the sensor input to compensate for thermal expansion of the workpiece 124 (or one or more bars 196), thermal expansion of the base plate 230 of the head 100 and voltage variations from the gap measurement sensor due to heat.

It is to be understood that even though numerous characteristics and advantages of various embodiments of the invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, the particular elements may vary depending on the particular application while maintaining substantially the same functionality without departing from the scope and spirit of the present invention. In addition, although the applications of the lapping device and head described herein are directed to lapping slider bars for fabrication of transducer heads, it will be appreciated by those skilled in the art that the teachings of the present application can be applied to other workpieces, without departing from the scope and spirit of the present invention.

What is claimed is:

1. A lapping assembly comprising:

a lapping head including a base plate coupled to a proximal end of a rotatable shaft to support one or more workpieces against an abrasive lapping surface on a platen; and a gap measurement sensor including a sensor element that is an opening of the base plate coaxially aligned with the rotatable shaft, the sensor element is configured to measure a gap between the sensor element and the platen.

2. A lapping assembly comprising:

a lapping head including a base structure coupled to a drive motor through a rotatable shaft, the base structure is configured to support one or more workpieces against an abrasive lapping surface;

a sensor device disposed in a no-conductive ring inset in the base structure of the lapping head; and an electrical connector comprising a rotatable portion coupled to a distal end of the rotatable shaft and a stationary portion electrically coupled to one or more electronic components or circuitry that are separate from the lapping head and configured to process input from the sensor device, wherein the rotatable portion and the stationary portion together provide an electrical interface between the sensor element on the lapping head and the one or more electronic components or circuitry.

3. The lapping assembly of claim 2 wherein the electrical connector utilizes electrically conductive fluid to electrically connect one or more leads extending through the shaft and through the rotatable portion of the electrical connector to one or more leads connected to the stationary portion of the electrical connector.

4. The lapping assembly of claim 2 wherein the base structure of the head is coupled to a proximal end of the shaft and the electrical connector is coupled to a distal end of the shaft and the drive motor is axially spaced from a rotation axis of the shaft and is operably coupled to the shaft through a gear assembly to rotate the shaft for lapping.

5. The lapping assembly 4 wherein the gear assembly includes a first gear axially aligned with the motor and rotatable via rotation of the motor and a second gear coaxially aligned with the shaft and rotated via the motor through rotation of the second gear through engagement of the first gear.

6. The lapping assembly of claim 2 wherein the abrasive lapping surface is on a conductive platen and the sensor device is an eddy current sensor including a sensor element to induce an eddy current in the platen to measure a gap between the sensor element and the conductive platen.

7. The lapping assembly of claim 6 including the non-conductive ring inset in the base structure of the lapping head and the eddy current sensor is disposed in the non-conductive ring.

8. The lapping assembly of claim 2, and further comprising a temperature sensor on the base structure of the lapping head electrically connected to the one or more electronic components or circuitry through the electrical connector.

9. The lapping assembly of claim 2 wherein the base structure includes a base plate including a plurality of flutes formed about a circumference of the base plate to dissipate heat.

10. A lapping assembly comprising:

a lapping head including a base plate coupled to a proximal end of a rotating shaft to support one or more workpieces against an abrasive lapping surface on a platen;

a gap measurement sensor including a sensor element that is inset in an opening of the base plate coaxially aligned with the rotatable shaft, the sensor element is configured to measure a gap between the sensor element and the abrasive lapping surface on the platen; and an electrical connector comprising a rotatable portion coupled to a distal end of the rotating shaft and a stationary portion electrically coupled to one or more electronic components or circuitry that are separate from the lapping head and configures to process input from the sensor element, wherein the rotatable portion and the atationary portion together provide an electrical interface between the sensor element on the rotating lapping head and the one or more electronic components or circuitry.

11. The lapping assembly of claim 10 wherein the lapping head is coupled to a drive motor through the rotating shaft to rotate the base plate relative to the abrasive lapping surface.

12. The lapping assembly of claim 11 wherein the drive motor is axially spaced from the shaft and coupled to the shaft through a gear assembly including a first gear axially aligned with the motor and rotatable via rotation of the motor and a second gear coaxially aligned with the shaft and rotated via the motor through engagement of the first gear relative to the second gear.

13. The lapping assembly of claim 10 wherein the electrical connector provides an electrical connection through a conductive fluid.

14. The lapping assembly of claim 10 wherein the platen is conductive and the sensor is an eddy current sensor configured to measure the gap between the sensor element and the abrasive lapping surface on the conductive platen.

15. The lapping assembly of claim 14 wherein the eddy current sensor is inset in an insulated ring disposed in an opening of the base plate.

16. The lapping assembly of claim 10 and comprising a temperature sensor on the base plate connectable to the one or more electronic components or circuitry through the electrical connector.

* * * * *